United States Patent [19]

Naimer

[11] Patent Number: 4,649,358

[45] Date of Patent: Mar. 10, 1987

[54] RESET MECHANISM FOR A ROTARY SWITCH

[76] Inventor: Hubert L. Naimer, Nuvola Bianca, CH-6612 Ascona, Switzerland

[21] Appl. No.: 806,697

[22] Filed: Dec. 9, 1985

[30] Foreign Application Priority Data

Dec. 17, 1984 [AT] Austria ..... 3999/84

[51] Int. Cl.[4] ..... H01H 9/00; H01H 67/02

[52] U.S. Cl. ..... 335/116; 335/20; 335/166

[58] Field of Search ..... 335/20, 26, 30, 114, 335/116, 122–123, 140, 166, 173

[56] References Cited

U.S. PATENT DOCUMENTS 4,390,855 6/1983 Alsch ..... 335/116 X

FOREIGN PATENT DOCUMENTS 2084804 4/1982 United Kingdom ..... 335/20

*Primary Examiner*—Arthur T. Grimley
*Assistant Examiner*—Jane K. Lau
*Attorney, Agent, or Firm*—Kurt Kelman

[57] ABSTRACT

A reset mechanism for a rotary switch, which is manually switchable from a rest position into any desired switch position, for resetting the switch in response to a drop of the electric power supply grid voltage below a predetermined minimum voltage, which includes an electromagnet with an armature, a switching drive shaft including a hand grip section for manually turning the drive shaft into any desired switch position, and a further section having a pinion, shaft sections being freely rotatable relative to each other. A reset device is displaceable transversely to the shaft axis, the reset device including a rack arranged to mesh with the drive shaft pinion and biased by a return spring. A blocking ram is resiliently supported on the armature for displacement in the direction of the shaft axis. An entrainment element is actuatable by the hand grip shaft section, and a transmission member is arranged on the entrainment element between the reset device and the blocking ram and is movable essentially in the direction of the shaft axis. When the grid voltage is above the predetermined minimum to attract the armature, the blocking ram is coupled to the reset device but when the voltage drops below the minimum and the armature is released, the reset device is automatically released for resetting the switch.

8 Claims, 8 Drawing Figures

RESET MECHANISM FOR A ROTARY SWITCH

The present invention relates to a reset mechanism for a rotary switch, which is manually switchable from a rest position into any desired switch position, for resetting the switch in response to a drop of the electric power supply grid voltage below a predetermined minimum voltage, which comprises an electromagnet including a coil connectable to the electric power supply grid for energization thereof and an armature attractable by the electromagnet upon energization of the coil, a switching drive shaft having a longitudinal axis, the drive shaft including a section having a pinion, a reset device displaceable transversely to the shaft axis, the reset device including rack means arranged to mesh with the drive shaft pinion and detent means, a return spring biasing the displaceable reset device, and blocking ram device resiliently supported on the armature for displacement in the direction of the shaft axis, the ram device including detent means for blocking the reset device in any of the desired switch positions of the switch when the armature is attracted, and the blocking ram device releasing the reset device when the voltage drops below the predetermined minimum voltage.

A rotary switch reset mechanism of this type has been disclosed in Austrian Pat. No. 367,566. In this known arrangement, the reset device has elements in engagement with the switching drive shaft and the blocking ram device has rams directly acting upon the reset device elements. This rotary switch reset mechanism has worked very well under conditions which do not require a free or automatic release.

It is the primary object of this invention to improve this type of rotary switch reset mechanism so that a trip-free or automatic release is possible with a simple structure.

The above and other objects are accomplished according to the invention with a switching drive shaft including a hand grip section for manually turning the drive shaft into any desired switch position freely rotatable relative to a section having a pinion. An entrainment device is actuatable by the shaft section which is freely rotatable relative to the section having the pinion meshing with the reset device rack, and a transmission means is arranged on the entrainment device for between the reset and blocking ram devices and is movable essentially in the direction of the shaft axis. The transmission means includes detent means engageable with the detent means of the reset and the blocking ram devices, engagement of the detent means of the blocking ram device and the transmission means and of the transmission means and the reset device being maintained only by a force effective in the direction of attraction of the armature for transmitting forces of a sufficient strength to move the switch out of its rest position.

In this structure, the entrainment device elements with their associated transmission means members and the reset device entrain the switching drive shaft, provided the electromagnet core has attracted the armature because otherwise the transmission means members cannot be held in engagement with the reset device elements. In any of the desired switch positions other than the rest position of the switch, the reset device elements are disengaged from the associated transmission means members as soon as the armature is released from the electromagnet core when the electric power supply grid voltage drops below a predetermined minimum voltage, causing the reset device elements to turn the switch back to its rest position.

The trip-free release structure of the present invention requires relatively few parts and the force transmission through a rack engaging a pinion enables the transmission force to be distributed over relatively large surfaces so that the structural parts may be made of synthetic resin without causing any problems.

The above and other objects, advantages and features of this invention will become more apparent from the following detailed description of a now preferred embodiment thereof, taken in conjunction with the accompanying drawing wherein FIG. 1 shows an axial section of a rotary switch incorporating the reset mechanism of the invention;

Figure 1:
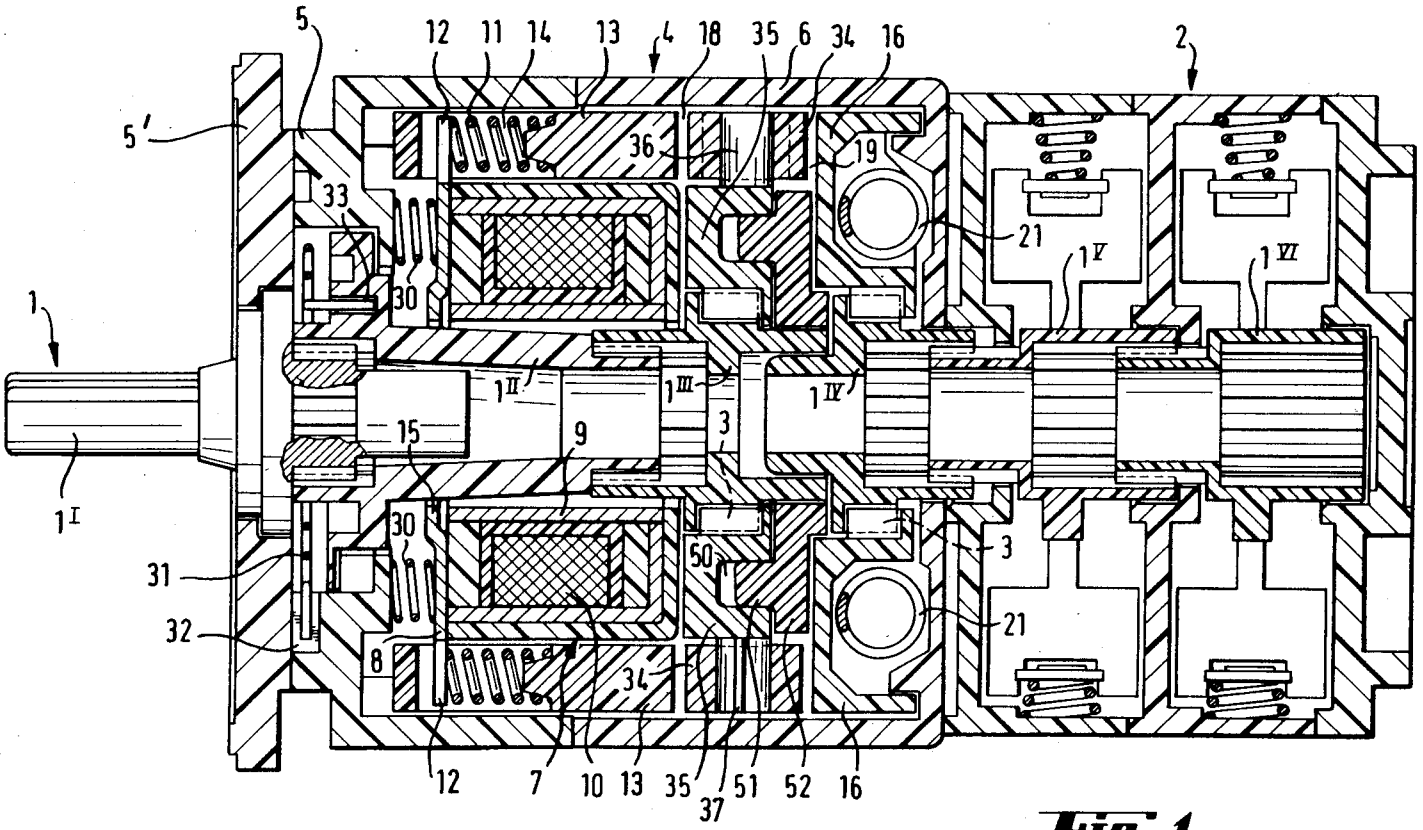
Figure 2:
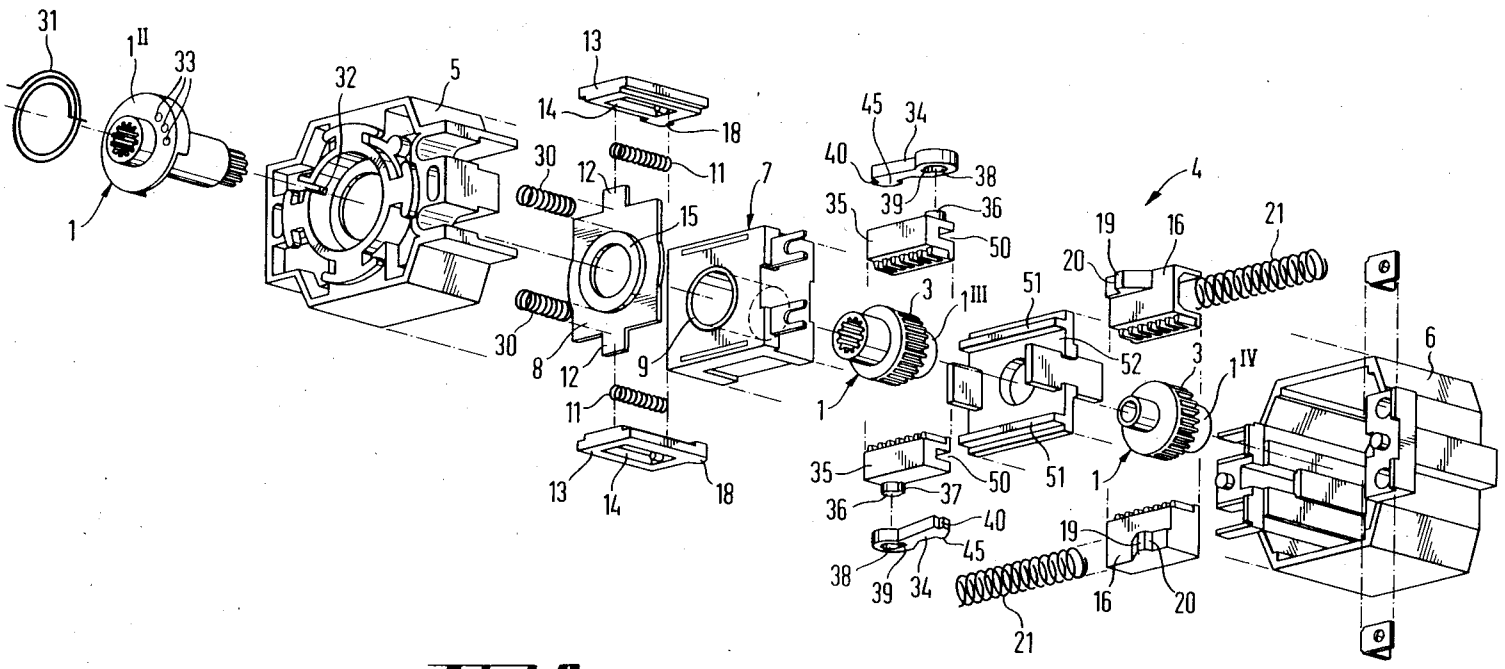
FIG. 2 is an explosive perspective view showing the parts of the reset mechanism of FIG. 1.

Referring first to FIGS. 1 and 2, there is shown reset mechanism 4 for rotary switch 2, which comprises electromagnet 7 whose coil 10 of core 9 is connectable to an electric power supply grid, preferably by a rectifier bridge, and which includes armature 8 attractable by the electromagnet core. The rotary switch comprises switching drive shaft 1 having a longitudinal axis and passing through electromagnet 7. The drive shaft includes four sections. Two-part shaft section $1^{v}$, $1^{vi}$ passes through switch 2 and controls the rotary switch contacts which are arranged in two adjacent, axially spaced planes in a manner well known in the art of rotary switches and forming no part of the present invention. Shaft section parts $1^{v}$, $1^{vi}$ are splined for common rotation into desired switch positions. A first hand grip shaft section is comprised of two parts 1', 1'' splined for common rotation and passing through reset mechanism 4, which enables switching drive shaft 1 to be turned into any desired switch position. Second section 1''' is fixedly connected to the first shaft section for rotation therewith and third shaft section $1^{iv}$ has pinion 3, sections 1''' and $1^{iv}$ being freely rotatable relative to each other. Two-part shaft sections 1, 1'' and $1^{v}$, $1^{vi}$ are splined, respectively, to adjacent shaft sections 1''' and $1^{iv}$ so that they rotate together, these shaft sections having meshing inner and outer splines connecting them.

Reset mechanism 4 is encased in two housing halves or parts 5 and 6 bearing switching drive shaft sections 1'', 1''' and $1^{iv}$. The housing halves encase pot electromagnet 7 with its armature 8 which is guided in suitable grooves in housing part 5, core 9 of the electromagnet having an axial bore permitting shaft sections 1'' and 1''' to pass therethrough.

Armature 8 has a pair of lugs 12 projecting from opposite sides thereof and engaging recesses 14 in blocking device rams 13 which are guided in grooves in housing part 5 and are resiliently supported on the armature for displacement in the direction of the shaft axis. For this purpose, compression coil springs 11 connect the blocking rams to the armature, one end of the springs pressing against armature lugs 12. Thus, the bias of the springs 11 is different if the armature is attracted to the core 9 of the electromagnet 7 or dropped. FIG. 1 illustrates the armature fully attracted to the core.

The side of the armature facing away from the core defines annular embossment 15 which provides an air gap enabling the armature to drop from the core.

To reduce the necessary force for attracting armature 8 to electromagnet core 9, very weak coil springs 30 (see FIG. 2) are arranged in housing half 5 to bias armature 8 against core 9 of the electromagnet, the biasing force of spring 30 being insufficient to prevent the armature from dropping away from the electromagnet core in any switch position other than the rest postion of rotary switch 2 when the grid voltage drops below a predetermined minimum voltage.

Spiral spring 31 has one end engaged in recess 32 of housing part 5 while an opposite end thereof engages a selected one of bores 33 in shaft section 1'' to pre-tension two-part hand grip section 1', 1'' slightly towards the rest position. This pre-tension may be adjusted by increasing or descreasing the tension of spiral spring 31, depending on which bore 33 is selected to receive the opposite spring end. The reset mechanism comprises reset device elements 16 displaceable transversely to the longitudinal axis of shaft 1 and each reset device element includes a rack arranged to mesh with drive shaft gear 3 and detent means 19, 20. Return springs 21 bias the reset device elements for transverse displacement relative to the shaft. Each blocking device ram 13 includes detent means 18 and, when reset device detent means 19, 20 and blocking ram device detent means 18 are in cooperation with each other, i.e. when the armature is attracted, the blocking device rams block the associated reset device elements in any of the desired switch positions of switch 2 while the reset device elements are released when the voltage drops below the predetermined minimum voltage, i.e. when the armature is released from the electromagent core.

According to the present invention, reset mechanism 4 further comprises entrainment device elements 35 actuatable by second shaft section 1''', for which purpose the entrainment device elements have racks meshing with pinion 3 on shaft section 1''', and transmission means members 34 arranged on the entrainment device elements between reset device elements 16 and blocking device rams 13 and movable essentially in the direction of the shaft axis under the bias of springs pressing blocking device rams 13 against transmission means members 34. The transmission means members have detent means 40, 45 engageable with the detent means of reset device elements 16 and blocking device rams 13. The engagement of detent means 18 of blocking device rams 13 and of transmission means members 34 and reset device elements 16 are maintained only by a force effective in the direction of attraction of the armature for transmitting forces of a sufficient strength to move the switch out of its rest position.

In the illustrated embodiment, each entrainment device element 35 includes pivot 36 having an axis extending perpendicularly to the longitudinal axis of shaft 1 and each transmission means member 34 is pivotally mounted on pivot 36 and extends essentially transversely to the shaft axis. Each pivot has a longitudinally extending tongue-like rib along its periphery substantially parallel to the pivot axis and transmission means member 34 defines axial bore 38 having longitudinally extending groove 39 corresponding to the rib, the pivot being received in the bore and the groove having a width exceeding the width of the rib. This mounting limits the pivotal movement of the free outer end of the transmission means members in the direction of the shaft axis to avoid any danger of jamming of the transmission means members. The arrangement makes expensive guides for the transmission means members unnecessary but it would also be possible to mount the transmission means members on the entrainment device elements longitudinally displaceably in the direction of the shaft axis.

Figure 4:
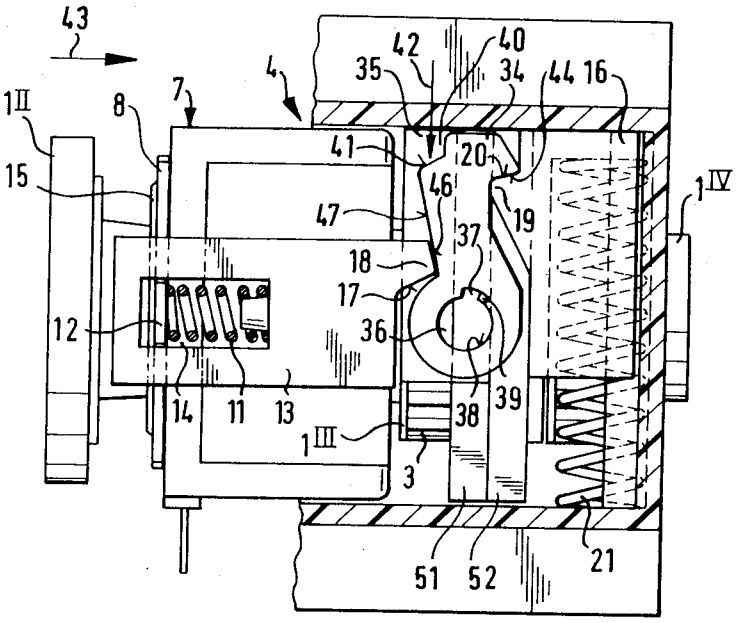
FIGS. 3 to 8 are enlarged top views, partly in section and with the housing removed, of the trip-free release mechanism in various switching positions and at different excitations of the electromagnet.
Figure 5:
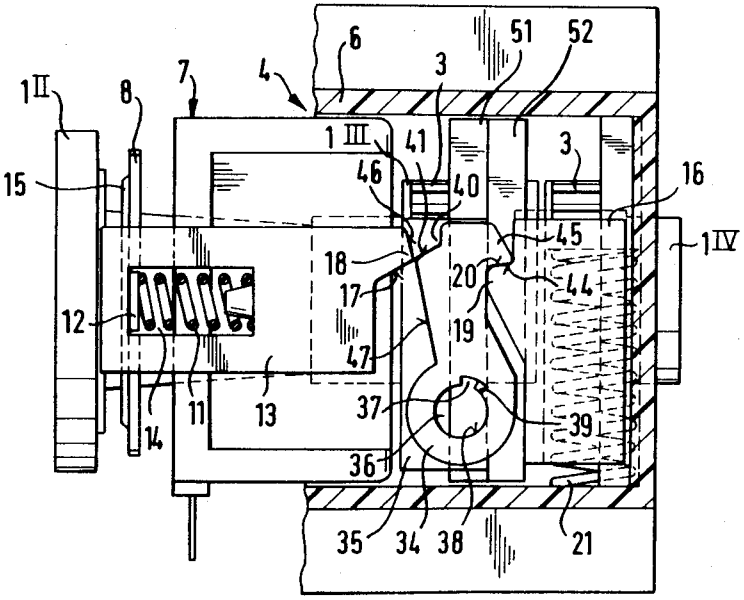

The preferred shapes of the detent means are best shown in FIGS. 3 to 8 wherein arrow 43 indicates the direction of attraction of armature 8 to the electromagnet core when the same is energized. Each transmission means member 34 has a side 47 facing the associated blocking device ram 13 and this side is inclined relative to the direction of attraction of the armature towards the free end of the pivotal transmission means member. The detent means of the transmission means member engageable with the detent means of the associated blocking device ram is arranged at the free end. This enables the bias of springs 21 for the reset device elements and springs 11 of blocking device rams 13 to be properly tuned to each other so that the bias of springs 21 is capable of returning the switch to its rest position, i.e. to cause reset device elements 16 to turn switching drive shaft 1 to the rest position, while the bias of springs 11 is sufficient to block the reset device elements in position when the armature is attracted, i.e. to keep the reset device elements engaged. The detent means of the transmission means members is defined by retaining recess 40 which has inclined wall portion 41 facing correspondingly inclined wall portion 17 of catch 18 which constitutes the detent means of the blocking device ram 13, catch 18 being retained in recess 40 in any one of the desired switching positions other than the rest position. Facing portions 41 and 17 have camming faces so inclined opposite to the direction of displacement of blocking device ram 13 that the force exerted by reset device element 16 on blocking device ram 13 perpendicularly to the direction of displacement of the blocking device ram, as indicated by arrow 42, generates a torque in the sense of disengagement of detent means 40, 18. When a force is applied to wall portion 41 in the direction of arrow 42 by wall portion 17 (see FIG. 3), a force component is generated in a sense opposite to direction of attraction 43 of the armature. When armature 8 is displaced from the electromagnet core and the bias of springs 11 is correspondingly reduced, wall portion 17 and wall portion 41 will glide out of engagement and blocking device rams 13 will be pressed back out of its blocking position against the reduced bias of springs 11 and weak springs 30. This means that, when switch 2 is in any switching position other than its rest position (FIG. 3) and armature 8 is no longer retained or attracted by the electromagnet core because the grid voltage connected thereto falls below a predetermined minimum voltage, blocking device rams 13 will be pressed against the weak bias of springs 30 in a direction opposite to direction of attraction 43 of the armature so that facing wall portions 17 and 41 will glide out of engagement (FIG. 5). This causes blocking device rams 13 to be disengaged from associated transmission means members 34, and reset device elements 16 biased by springs 21 and in meshing engagement with section $1^{iv}$ of switching drive shaft 1 will turn the shaft until switch 2 has reached its rest position. The detent means of each reset device element 16 is constituted by hook-shaped catch 19 having face 20 and the detent means of each transmission means member 34 is constituted by hook-shaped catch 45 having face 44 for hook-like engagement with each other. Camming faces 20, 44 are arranged for hook-like engagement with each other and are so inclined during a transmission of force for entraining the reset device element as to generate a torque in the sense of disengagement. In the case of the illustrated pivotal transmission means member 34, this may be obtained by so inclining the camming faces of catches 19 and 45 that a perpendicular to the plane of contact between camming faces 20 and 44 and passing through the center point of this plane of contact has a normal distance from the pivoting axis of transmission means member 34, as the contacting camming surfaces are inclined relative to the guides along which the transmission means member is movable in the direction of the shaft axis. In the position illustrated in FIG. 4, reset device element 16 is hooked to transmission means member 34 and thus coupled to entrainment device element 35. Since this element has a rack in mesh with the pinion on shaft section 1''' and this shaft section is splined to two-part hand grip section 1', 1'', the latter is turned back into its rest position, this return movement being reinforced by spiral spring 31.

Figure 3:
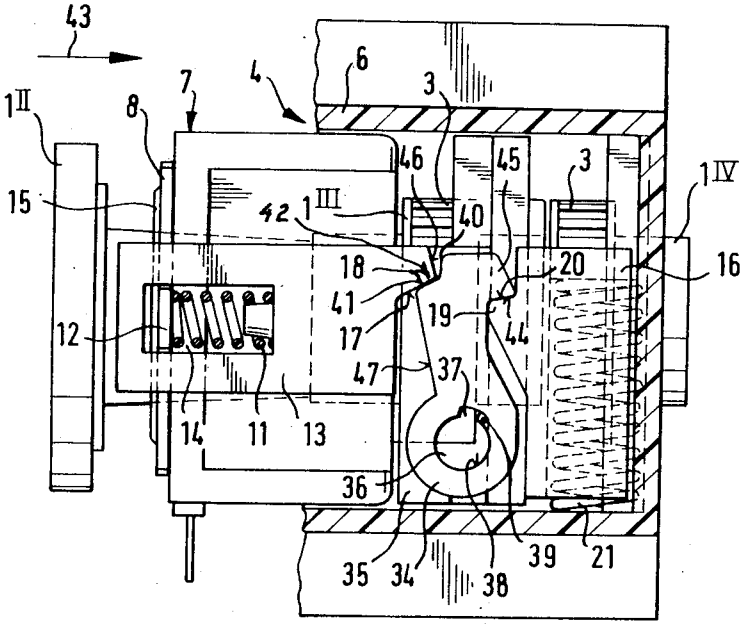
Figure 7:
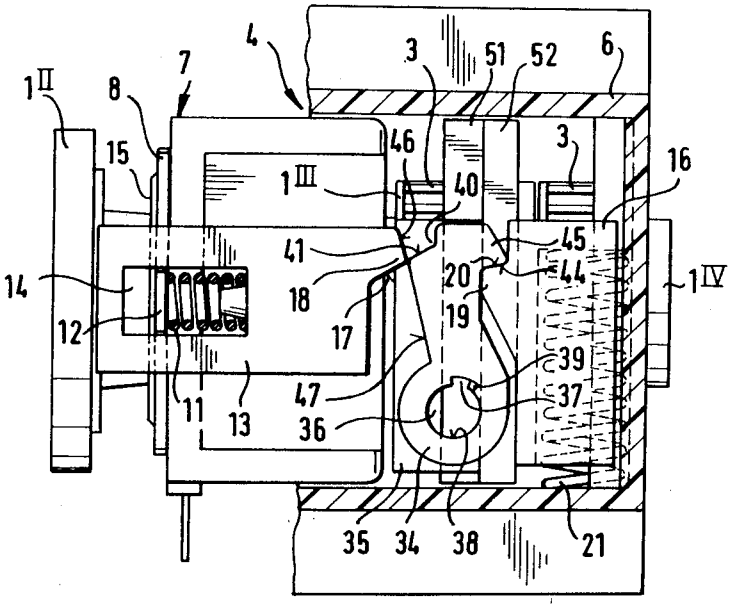

On the other hand, when armature 8 is attracted and coil springs 11 are correspondingly compressed, their bias has sufficient force to displace blocking device rams 13 in the direction of the shaft axis so that they are in engagement with transmission means members 34 while the latter are retained in hooked engagement with reset device elements 16, thus preventing the reset device elements from turning two-part contact control shaft section $1^{v}$, $1^{vi}$ of switch 2 from the switch position to the rest position (see FIG. 3). The manual resetting of the switch into its rest position is facilitated by a hand grip (not shown) keyed to part 1' of two-part hand grip shaft section 1', 1'', which projects from reset mechanism housing 5, 6 and is mounted outside cover 5' of the housing. For this purpose, the bias of springs 11 is so attuned to the inclinations of camming faces 17 and 41 that blocking device rams 13 may be retracted against this bias by turning shaft 1 even when armature 8 is attracted whereby entrainment device elements 35 and, therefore, reset device elements 16 are unblocked, causing the reset elements to turn the contact control shaft section of switch 2 into its rest position, due to the relaxing of springs 21, while they entrain transmission means members 34 and entrainment device elements 35 (FIG. 7).

When switch 2 is switched from its rest position while armature 8 is attracted, which presupposes an electric power supply grid voltage above the predetermined minimum, the force generated by springs 11 compressed by the attracted armature is sufficient to cause detent catch 45 of transmission means member 34 to remain in hooked engagement with detent catch 19 of reset device element 16 although a perpendicular to the plane of contact between camming faces 20 and 44 and passing through the center point of this plane of contact has a normal distance from the pivoting axis of transmission means member 34 and, therefore, a force transversely to that of direction of attraction 43 of armature 8 produces a torque causing camming faces 20, 44 of catches 19, 45 to eventually glide out of engagement (FIG. 4). This enables reset device elements 16 to be entrained by entrainment device elements 35 and their transmission means members 34 whereby shaft sections 1''' and $1^{iv}$ of switching drive shaft 1, which are otherwise freely rotatable relative to each other, are coupled together for common rotation by entrainment device elements 35, transmission means members 34 and reset device elements 16, the racks of the entrainment device and reset device elements meshing with pinions 3 on shaft sections 1''' and $1^{iv}$.

As shaft 1 is turned further, inclined face 46 of catch 18 of blocking device rams 13 glides up along inclined side 47 transmission means members 34, which causes the blocking device rams to be forced back slightly against direction of attraction 43 of armature 8. This, in turn, causes the tension of springs 11 to increase until the position illustrated in FIG. 3 has been reached, in which catch 18 is retained in detent recess 40 of transmission means member 34. In this end position, blocking device rams 13 block reset device elements 16, which are under the pressure of springs 21, transmission means members 34 being in hooked engagement with the reset device elements.

Figure 6:
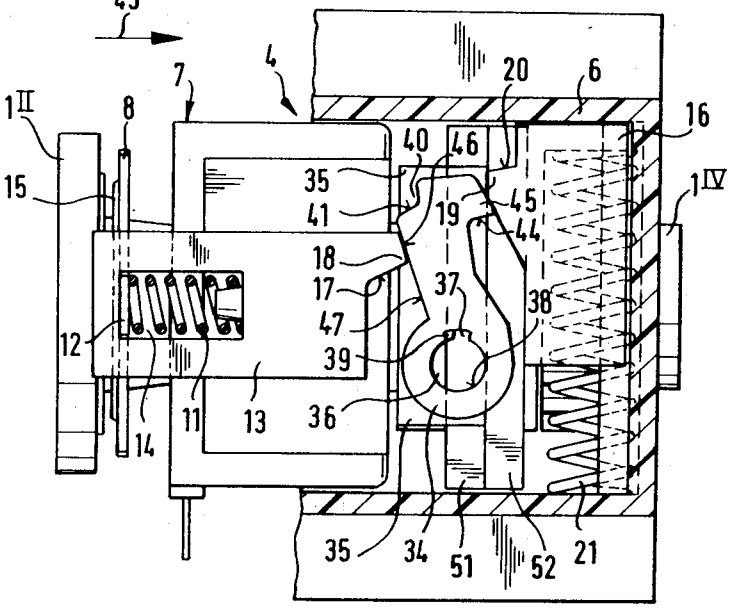
Figure 8:
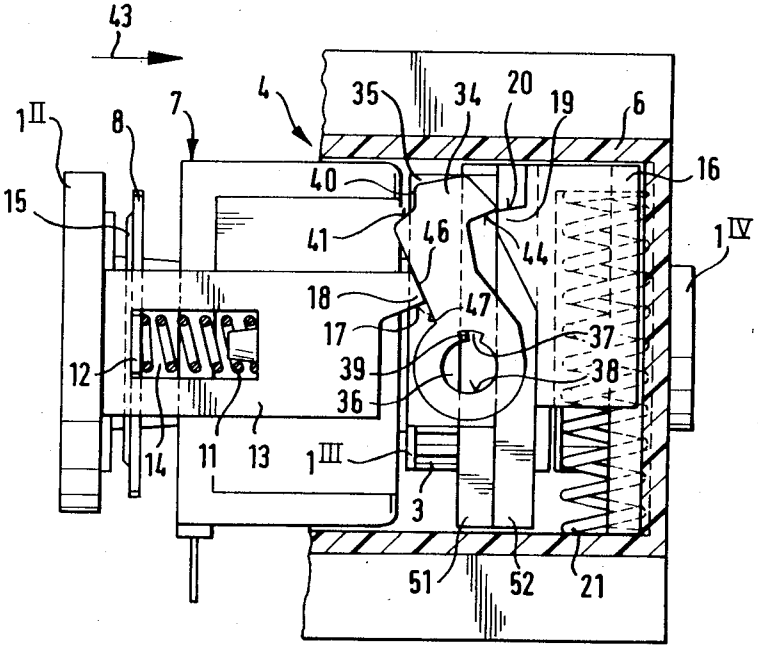

If there is no voltage applied to the electromagnet core or if this voltage drops below the predetermined minimum so that armature 8 is released from the core, shaft sections 1''' and $1^{iv}$ cannot be coupled together and are, therefore, freely rotatable relative to each other. The reason for this is that weak springs 30 exert an insufficient force on armature 8 to press the same against the electromagnet core so that the blocking device rams cannot exert a torque of a sufficient force on the transmission means members to overcome the torque exerted by a switch actuating force on inclined camming faces 20, 44 of the detent means of reset device elements 16 and transmission means members 34. Therefore, any attempt to move switch 2 out of its rest position when the grid voltage drops below the predetermined minimum, will cause camming faces 20, 44 to glide out of engagement, as is shown in FIG. 8. While the hand grip keyed to two-part switching drive shaft section 1', 1'' can turn shaft section 1''', which is splined to the two-part hand grip shaft section for rotation therewith, two-part shaft section $1^{v}$, $1^{vi}$ of switch 2 remains in the rest position since it is splined to shaft section $1^{iv}$ which is not entrained by reset device elements 16 since shaft sections 1''' and $1^{iv}$ are not coupled to each other in this position (FIG. 6).

What is claimed is:

1. A reset mechanism for a rotary switch, which is manually switchable from a rest position into any desired switch position, for resetting the switch to the rest position in response to a drop of electric power supply grid voltage below a predetermined minimum voltage, which comprises (a) an electromagnet including
  (1) a coil connectable to the electric power supply grid for energization thereof and
  (2) an armature attractable by the electromagnet coil energized by the grid voltage, (b) a switching drive shaft having a longitudinal axis, the drive shaft including
  (1) a hand grip section for manually turning the drive shaft into any desired switch position and
  (2) a further shaft section having a pinion,
  (3) said hand grip section and said further shaft section being freely rotatable relative to each other, (c) a reset device displaceable transversely to the shaft axis, the reset device including
  (1) rack means arranged to mesh with said further shaft section pinion and
  (2) detent means, (d) return spring means biasing the displaceable reset device, (e) a blocking ram device resiliently supported on the armature for displacement in the direction of the shaft axis, the blocking ram device including (1) detent means for blocking the reset device in any of the desired switch positions of the switch when the armature is attracted, and the blocking ram device releasing the reset device when a voltage drops below a predetermined minimum voltage, (f) an entrainment device actuatable a section of the hand grip section, and (g) transmission means arranged on the entrainment device between the reset device and the blocking ram device, the transmission means being movable essentially in the direction of the shaft axis and including (1) detent means engageable with the detent means of the reset device and the blocking ram device, engagement of the detent means of the blocking ram device and the transmission means and of the transmission means and the reset device being maintained only by a force effective in the direction of attraction of the armature for transmitting forces of a sufficient strength to move the switch out of its rest position.

2. The rotary switch reset arrangement of claim 1, wherein the entrainment device has entrainment elements each including a pivot having an axis and the transmission means has transmission members pivotally mounted on the pivots and extending essentially transversely to the shaft axis.

3. The rotary switch reset arrangement of claim 1, wherein the pivots have longitudinally extending ribs along their peripheries substantially parallel to the pivot axes and the transmission members define axial bores having longitudinally extending grooves corresponding to the ribs, the pivots being received in the bores and the grooves having a width exceeding the width of the ribs.

4. The rotary switch reset arrangement of claim 1, wherein the detent means of the reset device and of the transmission means are arranged for hook-like engagement with each other, respective camming faces of the engaging detent means during a transmission of force for entraining the reset device being so inclined as to generate a torque in the sense of disengagement of the detent means.

5. The rotary switch reset arrangement of claim 1, wherein the detent means of the blocking ram device and of the transmission means have facing portions engaging each other in any one of the desired switching positions other than the rest position, the facing portions having camming faces so inclined opposite to the direction of displacement of the blocking ram device that the force exerted by the reset device on the blocking ram device perpendicularly to the direction of displacement of the blocking ram device generates a torque in the sense of disengagement of the detent means.

6. The rotary switch reset arrangement of claim 1, wherein the detent means engageable with the detent means of the blocking ram device is arranged at one end of the transmission means and the transmission means has a side facing the blocking ram device, the transmission means side being inclined relative to the direction of attraction of the armature.

7. The rotary switch reset arrangement of claim 1, wherein the hand grip shaft section is pre-tensioned towards the rest position.

8. The rotary switch reset arrangement of claim 1, wherein said switching drive shaft having a longitudinal axis passing through said electromagent.

* * * * *